US007341356B1

(12) United States Patent
Zadro

(10) Patent No.: US 7,341,356 B1
(45) Date of Patent: Mar. 11, 2008

(54) DUAL MAGNIFICATION VANITY MIRROR ADJUSTABLE IN HEIGHT AND ORIENTATION

(76) Inventor: Zlatko Zadro, 5422 Argosy Dr., Huntington Beach, CA (US) 92649

( * ) Notice: Subject to any disclaimer, the term of this patent is extended or adjusted under 35 U.S.C. 154(b) by 151 days.

(21) Appl. No.: 11/218,964

(22) Filed: Sep. 2, 2005

(51) Int. Cl.
*G02B 5/08* (2006.01)
*G02B 7/182* (2006.01)

(52) U.S. Cl. ..... 359/840; 359/872; 359/881; 248/474; 248/481; 248/485

(58) Field of Classification Search ..... 359/840, 359/872, 881; 248/469, 470, 471, 472, 473, 248/474, 481, 484, 485, 477, 479
See application file for complete search history.

(56) References Cited

U.S. PATENT DOCUMENTS

| | | | | | |
|---|---|---|---|---|---|
| 90,746 | A * | 6/1869 | Hartmann | 248/480 |
| 354,976 | A * | 12/1886 | Field | 248/484 |
| 898,263 | A * | 9/1908 | Rice | 248/474 |
| 1,050,321 | A * | 1/1913 | Winzenburg | 359/860 |
| 1,190,050 | A * | 7/1916 | Verba | 600/247 |
| 1,788,209 | A * | 1/1931 | Sheehan | 40/780 |
| 2,017,472 | A * | 10/1935 | Re | 248/474 |
| 2,338,780 | A * | 1/1944 | Poncher et al. | 248/483 |
| 3,977,645 | A * | 8/1976 | Deely | 248/484 |
| 5,259,582 | A * | 11/1993 | DeLange, III | 248/481 |
| 5,604,633 | A * | 2/1997 | Christianson | 359/507 |
| 6,039,455 | A * | 3/2000 | Sorenson | 362/142 |
| 6,273,585 | B1 * | 8/2001 | Wu | 362/135 |
| 6,305,809 | B1 * | 10/2001 | Zadro | 359/840 |
| 6,679,612 | B1 * | 1/2004 | West et al. | 359/871 |
| 6,830,154 | B2 * | 12/2004 | Zadro | 206/581 |
| D532,981 | S * | 12/2006 | Zadro | D6/310 |

FOREIGN PATENT DOCUMENTS

FR 807158 * 1/1937

* cited by examiner

*Primary Examiner*—Ricky D. Shafer
(74) *Attorney, Agent, or Firm*—William L. Chapin

(57) ABSTRACT

A dual magnification vanity mirror adjustable in height and orientation includes an elongated stanchion curved into the shape of a C having a downwardly depending threaded support leg insertably receivable through a central hole in a base plate and removably fastenable thereto by a nut threaded onto the leg. The mirror includes a mirror frame which holds therein a pair of back-to-back mirror plates of different relative magnifications, the frame being joined by a ball-and-socket joint to a bushing rotatably mounted on a horizontal end arm of the stanchion, whereby the frame is swivelable and/or rotatable about an axis of the ball-and-socket joint to adjustable azimuth and inclination angles, orbital about a longitudinal axis of the coupler bushing to an adjustable height, and secured thereat by a screw tightened into radial bore through the bushing onto the arm.

19 Claims, 3 Drawing Sheets

DUAL MAGNIFICATION VANITY MIRROR ADJUSTABLE IN HEIGHT AND ORIENTATION

BACKGROUND OF THE INVENTION

A. Field of the Invention

The present invention relates to mirrors of the type used by people to facilitate performance of personal appearance related functions such as shaving, applying cosmetics and the like. More particularly, the invention relates to a portable mirror which is transportable as a relatively thin, flat package, and easily assembleable by a user into a versatile free-standing mirror for placement on a table top, vanity cabinet or the like, the mirror including a mirror frame which holds a pair of mirror plates of different relative magnifications, the frame being joined by a ball and socket joint to a rotatable union to a support stand stanchion in a manner enabling either selected mirror plate to be adjusted over a wide range of elevations and viewing angles.

B. Description of Background Art

Some aspects of a person's appearance are best attended to by observing his or her image in a relatively large "wide angle" mirror, which has a flat reflective surface that provides a unity or "1×" magnification. Mirrors of this type include full length wall mirrors, dresser mirrors, and bathroom mirrors mounted on a wall or cabinet. On the other hand, certain personal grooming functions such as shaving, applying cosmetics and the like are generally more easily performed while viewing a larger image of one's face, which can be obtained by positioning the face closer to a flat, non-magnifying mirror. In some circumstances, however, it is not convenient to position one's face sufficiently close to an existing flat mirror to provide an image which is sufficiently large to enable a desired personal grooming task to be easily performed. In such situations, it would be desirable to have available a magnifying mirror, i.e., a mirror having a magnification factor greater than one. Since counter space available in locations such as bathrooms is often at a premium, it would also be desirable to have available a portable magnifying mirror which may be readily placed in a free-standing disposition on a horizontal surface, such as that of an existing table top or vanity top. Additionally, since different mirror magnifications are useful for performing different aspects of a person's grooming, it would be desirable to have a portable free-standing mirror, which had a range of different, selectable magnifications.

A wide variety of magnifying and non-magnifying mirrors are available for use in people's homes. However, since a person's vision generally degrades with age, there is an accompanying need for a small mirror of selectable magnification which can supplement existing larger mirrors to enable a person to see image details required to perform personal care functions. In U.S. patent application Ser. No. 10/698,619 filed on Oct. 31, 2003, now U.S. Pat. No. 6,854,852, the present inventor disclosed a Dual Magnification Reversible Spot Mirror Releasably Attachable To Flat Surfaces. The mirror described therein includes two mirror plates of different magnification factors held back-to-back in a frame reversibly retainable in a frame holder pivotably supported by a mounting base releasably attachable by a suction cup to a flat surface such as a vertical surface of a larger mirror or the horizontal surface of a table top.

In the present applicant's co-pending U.S. patent application Ser. No. 11/080,252, filed Mar. 16, 2005, for an Illuminated Dual Magnification Table Mirror/Magnifier, the applicant discloses a portable table mirror which includes a pair of back-to-back mirror plates of different relative magnifications held in a circular mirror frame that is rotatably mounted in a ring-shaped mirror frame support ring which contains a ring-shaped florescent lamp, and which is pivotably mounted to the upper end of a support stanchion, thus enabling the elevation angle and height of a selected mirror to be adjusted. The present invention was conceived of to provide a compact dual magnification table-top/vanity mirror which is transportable in a relatively thin package, quickly assembleable by a user, and adjustably orientable over a wide range of heights, elevation angles, and azimuth angles.

OBJECTS OF THE INVENTION

An object of the present invention is to provide a mirror which has two mirror plates of different magnification factors mounted back-to-back in a frame swivelable to various heights, elevation angles, and azimuth angles relative to a support surface.

Another object of the invention is to provide a dual magnification vanity mirror which includes a support stand for supporting the mirror on the surface of a vanity, table top or the like, the mirror containing a frame holding two mirror plates which is adjustable in height and orientation angles relative to a support surface.

Another object of the invention is to provide a dual magnification vanity mirror which includes a support stand comprised of an elongated member curved into the shape of a C, the lower end of which has a short downwardly angled leg received through a central aperture through a circular base plate, and disassembleable from the base by removing a nut threaded onto a threaded lower end of the leg protruding from the lower surface of the base, thereby enabling the mirror to be packaged in a relatively thin container.

Another object of the invention is to provide a portable dual magnification table mirror which includes an elongated, arcuately curved, C-shaped rod that has a short vertical support leg removably attachable to a transversely disposed base plate, and a mirror frame holding therein a pair of back-to-back mirror plates, the mirror frame being mounted by a swivelable ball-and-socket joint which has a ball support stud transversely connected to a rotatable coupler rotatably connected to an upper generally horizontally disposed upper end arm of the rod, whereby the mirror frame can be swivelled and/or rotated about the axis of the ball-and-socket joint stud to desired azimuth angles and inclination angles relative to the frame, and rotated about a horizontally disposed axis of the coupler to position the mirror frame at desired heights relative to the base, and secured thereat by a thumbscrew tightened into a threaded bore disposed radially through the coupler, into an annular groove formed in the rod near its outer end.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a portable mirror which includes a support stand that has a base plate for supporting the mirror on a horizontal support surface such as that of a vanity cabinet or table-top, an arcuately curved stanchion rod which has a lower short straight base leg removably attachable to the center of the base plate to thereby protrude vertically upwards from the base plate, and a mirror frame swivelably and rotatably mounted to an upper end of the stanchion, the mirror frame holding therein a back-to-back pair of mirror plates of different relative magnifications.

The stanchion has parallel vertically disposed left and right side walls, and has in side elevation view an arcuately curved contour shape approximating that of the letter "C," including a lower half portion which curves rearwardly and upwardly from the upper end of the lower straight base leg, and an upper half portion which curves forwardly and upwardly from the lower half section. The upper half portion of the stanchion terminates in a short, straight, horizontally or slightly downwardly disposed upper end arm which has formed in an outer cylindrical wall surface thereof, rearward of the front transverse face of the stanchion rod, a radially inwardly disposed, flat-bottom groove, which has a rear annular shoulder located forward of a vertical center line through the base leg of the stanchion.

The dual magnification vanity mirror according to the present invention includes a cylindrically-shaped, rotatable coupler which has formed therein a blind longitudinally disposed coaxial bore which extends perpendicularly forward into the coupler from a rear transverse circular face of the coupler. The inner diameter of the coupler bore is slightly larger than outer diameter of the upper end arm of the stanchion, which is rotatably received within the bore. The coupler has an internally threaded, radially disposed bore located approximately midway between the front and rear faces of the coupler, the threaded bore penetrating the outer cylindrical wall surface and longitudinally disposed bore within the coupler. The threaded coupler bore receives the externally threaded shank of a thumbscrew which is tightenable in the threaded bore to bear against the bottom wall surface of the groove in the stanchion rod, thus fixing the coupler at an adjustable orbit angle against rotation around the rod.

According to the invention, the mirror frame is joined to the coupler by a ball-and-socket type joint. Thus, the mirror frame, which comprises a hoop-shaped ring which has front and rear annular edge walls which are inwardly curved to form lip flanges that bear against outer surfaces of a pair of front and rear, back-to-back mirror plates to retain them within the frame, has a cylindrically-shaped boss which protrudes radially outwardly from an outer cylindrical wall surface of the frame ring. The boss has a cylindrical bore in which is retained by an overlapping annular outer edge wall of the boss a socket made of a relatively hard, resilient material such as polyurethane. Captivated in the generally spherically-shaped bore of the socket is a generally spherically-shaped head of a ball which has a central coaxial rear shank or support stud that protrudes from the outer cylindrical wall surface of the rotatable coupler, on a side opposite that of the thumbscrew bore.

With the construction described above, the mirror frame is orbitable around the generally fore-and-aft disposed short upper end arm of the stanchion, by loosening the thumbscrew, rotating the coupler and attached mirror frame from a pendent position below the upper end of the stanchion arm to a position above the stanchion, or any intermediate orbital position on either the left side or right side of the stanchion, and re-tightening the thumbscrew to maintain the desired orbital position. Moreover, the mirror frame is rotatable over an unlimited angular range about the longitudinal axis of the ball-and-socket joint shank, thus, for example, positioning the mirror frame parallel to and generally concentrically within the concave opening of the C-shaped stanchion, for convenient use, or for configuring the arrangement between the stanchion and frame to a minimum thickness arrangement suitable for packaging or storage. Also, the ball-and-socket joint enables the mirror frame to be swivelably tilted over a wide range of angles both perpendicular to and parallel to the surfaces of the mirror plates.

DESCRIPTION OF THE PREFERRED EMBODIMENTS

FIGS. 1-6 illustrate a dual magnification vanity mirror adjustable in height and orientation according to the present invention.

Figure 2:
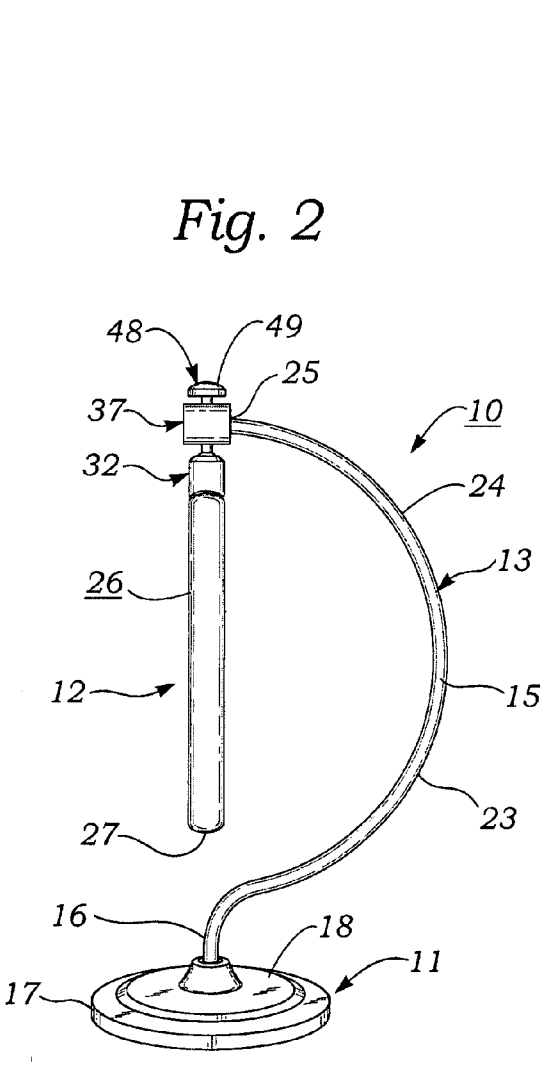
FIG. 2 is a right side elevation view of the mirror of FIG. 1.
Figure 1:
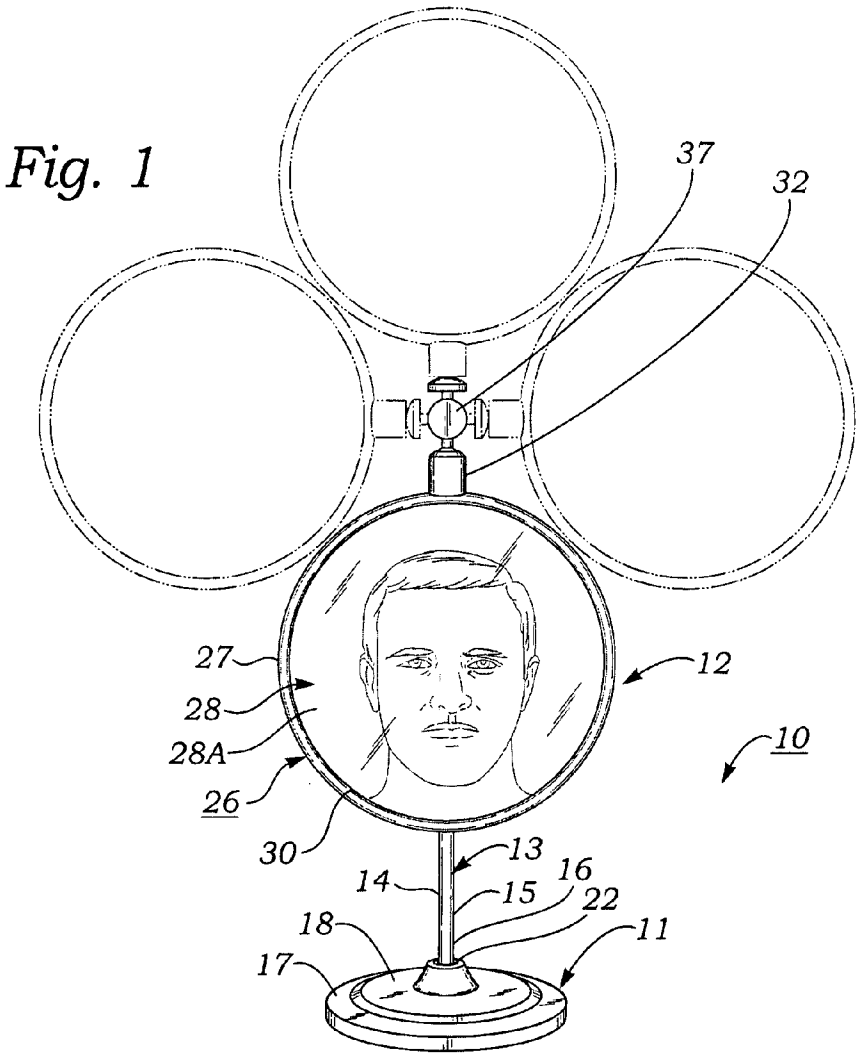
FIG. 1 is a front elevation view of a dual magnification vanity mirror adjustable in height and orientation according to the present invention, showing in three phantom views, a mirror frame thereof oriented to three alternate positions from a pendent position.

Referring first to FIGS. 1 and 2, it may be seen that a dual magnification vanity mirror 10 according to the present invention includes a support stand 11 and a mirror assembly 12 attached to an upper end of the support stand. As shown in FIG. 2, support stand 11 includes a stanchion 13 which has in side elevation view the shape of an arcuately curved elongated member, e.g., a circular cross-section rod, which has a contour shape approximating that of a capital letter "C." As shown in FIG. 1, stanchion 13 preferably has parallel, vertically disposed left and right sides 14, 15, respectively.

Figure 6:
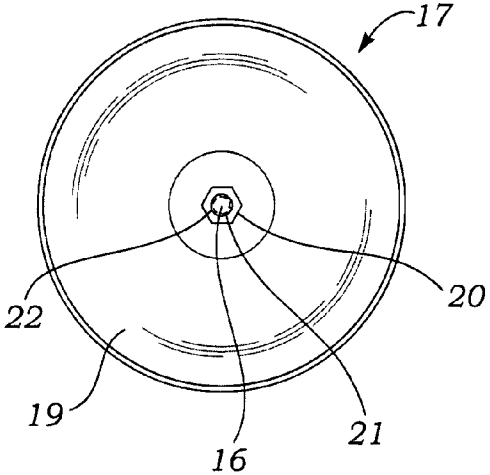
FIG. 6 is a lower plan view of the mirror of FIG. 1.

Referring to FIG. 2, C-shaped support stanchion 13 may be seen to include a short, straight, vertically downwardly disposed base leg 16. Base leg 16 protrudes vertically upwards from the convex upper surface 18 of a base plate 17 comprising a second component of support stand 11. As shown in the figures, base plate 17 preferably has a circular plan view shape, and, as shown in FIG. 6, a concave lower surface 19. Preferably, as shown in FIG. 6, base leg 16 of support stand stanchion 13 is removably attachable to support stand base plate 17, as for example, by a nut 20 tightened onto an externally threaded shank 21 of base leg 16, which protrudes downwardly through a coaxially located hole 22 through base plate 17.

Figure 7:
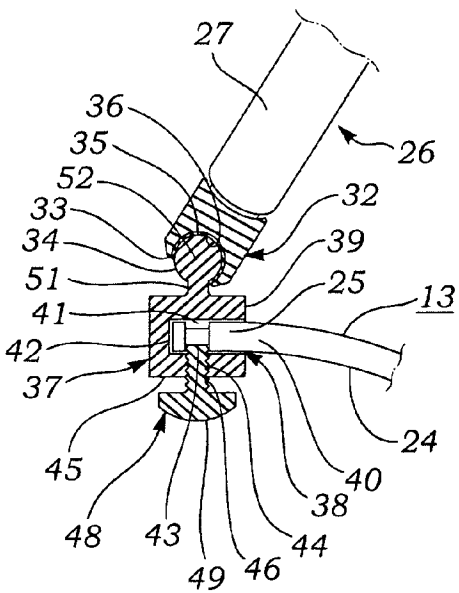
FIG. 7 is a fragmentary, partly sectional side elevation view of the mirror of FIG. 5, showing details of an orbital coupler and angularly adjustable ball-and-socket joint which joins the frame to the support stand thereof.

Referring to FIGS. 2 and 7, it may be seen that support stand stanchion 13 has a lower half section 23 which curves arcuately rearwardly and upwardly from an upper end of base leg 16, and an upper half section 24 which curves arcuately forwardly and upwardly from the lower half section. Stanchion 13 also has a short straight, generally horizontal forwardly disposed arm 25 which terminates upper half section 24.

Figure 4:
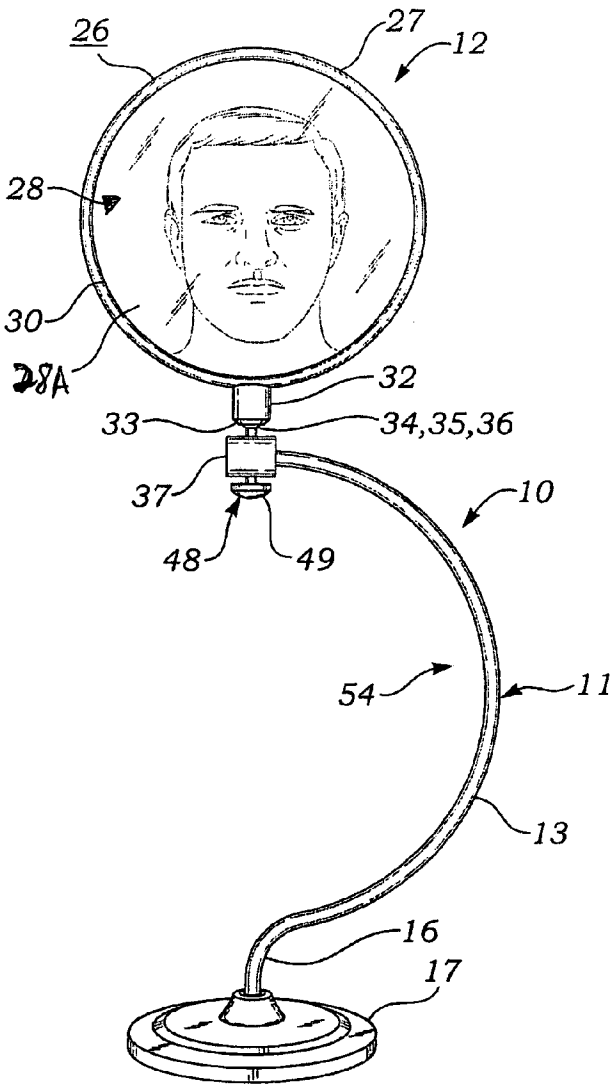
FIG. 4 is a view similar to that of Figure e, but showing the mirror frame thereof orbited 180 degrees to a position above the support stand, thereby orienting a first, 1× magnification mirror plate thereof to a use position.
Figure 3:
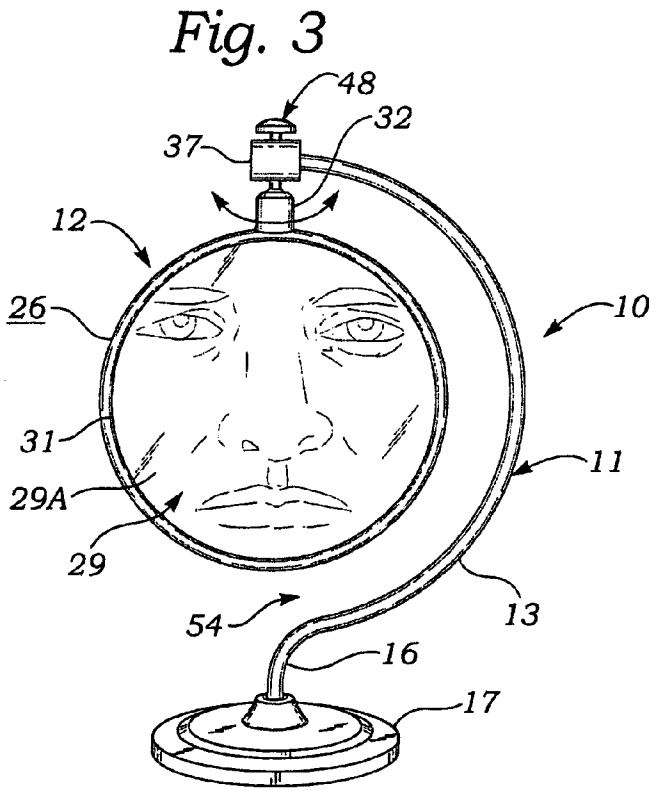
FIG. 3 is a side elevation view of the mirror of FIG. 1, showing a mirror frame thereof rotated ninety degrees clockwise about a vertical axis of a support stand thereof to orient a second, 5× magnification mirror plate mounted to a second side of the frame to a use position.

Referring now to FIGS. 1-4, it may be seen that mirror assembly 12 includes a circular or hoop-shaped frame 26 which has an outer, longitudinally disposed peripheral wall surface 27 which may be generally cylindrically shaped, but preferably is convexly curved, as shown in FIG. 2. Mirror frame 26 holds therewithin a pair of back-to-back first and second circular mirrors plates 28, 29 which have flat or concave reflecting surfaces 28A, 29A that produce different relative magnification factors, e.g., 1× and 5×. As shown in FIGS. 3 and 4, first and second mirror plates 28, 29 are retained within frame 26 by first and second annular lip flanges 30, 31 rolled radially inwardly from opposite longitudinal edges of outer longitudinal wall surface 27 of the frame.

FIGS. 3, 4 and 7 illustrate the construction of mirror 10 that enables orbital and angular adjustability of mirror assembly 12 relative to support stand 11.

As shown in FIGS. 3, 4 and 7, mirror frame 26 has protruding radially outwardly form outer longitudinally disposed wall surface 27 thereof a generally cylindrically-shaped coupling boss 32. Coupling boss 32 has formed in a radially outwardly located transverse end thereof a generally hemispherical cavity 34 in which is located a socket 35 which has a shape approximate that of a hemispherical shell that has a spherical inner wall surface 36. Socket 35 is preferably made of a material which is resilient but relatively hard, such as polyurethane.

Referring to FIG. 1 in addition to FIG. 7, it may be seen that mirror 10 includes a generally cylindrically-shaped coupler bushing 37 which is rotatably attached to upper end arm 25 of stanchion 13. Rotatable coupler bushing 37 has a blind smooth, coaxially located bore 38 which extends longitudinally forward into the body of the coupler from the rear transverse face 39 thereof. Bore 38 is of slightly larger diameter than that of end arm 25 of stanchion 13, thus enabling the bore to receive the end arm, and the coupler to rotate on the arm. As shown in FIG. 7, end arm 25 of stanchion 13 has formed an outer cylindrical wall surface 40 thereof a rectangular cross-section, annular groove 41. Groove 41 is located longitudinally inwardly of outer circular transverse end face 42 of arm 25, and has a flat, cylindrically-shaped bottom wall 43.

Referring still to FIG. 7, it may be seen that coupler bushing 37 has a threaded bore 44 disposed radially into central smooth blind bore 38 from outer cylindrical wall surface 45 of the coupler. Threaded bore 47 of coupler bushing 37 threadingly receives the threaded shank 46 of a screw 48 that has an enlarged, knurled head 49. Screw 48 is tightenable in threaded bore 44 to thereby press inner transverse end 50 of shank 46 onto bottom wall 43 of groove 41 in end arm 25, thus retaining the coupler at a fixed, orbitally adjusted position relative to the longitudinal axis of upper end arm 25 of stanchion 13.

Thus, the construction of rotatable coupler bushing 37 enables mirror frame 26 to be rotated about the generally horizontally disposed longitudinal axis of upper end arm 25 of stanchion 13 to any desired orbital angle, and retained thereat by re-tightening screw 48, as shown in FIG. 1.

As shown in FIG. 7, coupler bushing 37 of mirror 10 has a stud 51 which protrudes radially outwardly from outer cylindrical wall surface 45 of the coupler, axially aligned with but diametrically opposed to threaded bore 44. Stud 51 is terminated at an outer longitudinal end thereof by a generally spherically-shaped ball 52 which is frictionally received within socket 35 of mirror frame coupling boss 32, thus comprising therewith a ball-and-socket joint 53 that enables both swivelable and rotational motion of the mirror frame relative to stanchion 13, as shown in FIG. 5.

The construction of ball-and-socket joint 53 enables mirror frame 26 to be rotated about the longitudinal axis of stud 51, over any desired azimuth angle range. Thus, for example, mirror frame 26 is rotatable about ball-and-socket joint 53 ninety degrees from a forward facing perpendicular position relative to the plane of stanchion 13, as shown in FIGS. 1 and 2, to side facing positions in which the center plane of the frame is parallel to that of the stanchion, as shown in FIG. 3. In the parallel, side facing position of FIG. 3, an inner side, e.g., a right side, of stanchion frame 26 is located within a concave open space 54 adjacent a front side of stanchion 13. This arrangement configures mirror 10 into a minimum thickness, minimum depth configuration. Moreover, base plate 17 is detachable from stanchion 13 by removing attachment nut 20, thus enabling the plate to be stacked parallel to the frame and stanchion arranged as shown in FIG. 3, and boxed or stored in low-profile, small packages.

Figure 5:
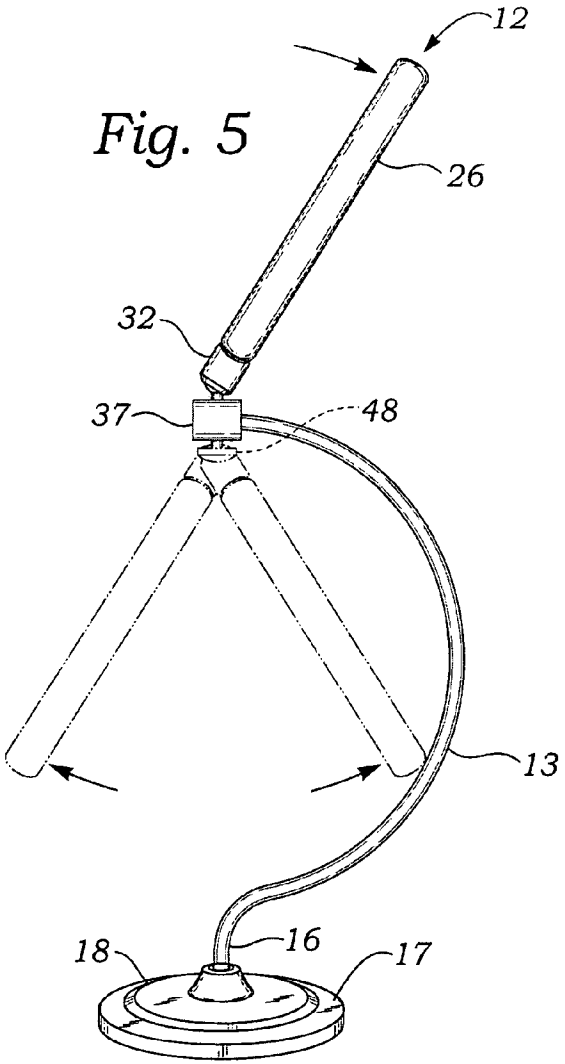
FIG. 5 is a side elevation of the mirror of FIG. 2, showing angular and orbital adjustability of the mirror frame with respect to the support stand thereof.

Angular freedom of motion of mirror frame 26 relative to coupler bushing 37 afforded by ball-and-socket joint 53 also enables the mirror frame to be tilted to various angular positions in a plane parallel to that of the mirror frame, as shown in FIG. 3, or perpendicular to the mirror frame, as shown in FIG. 5.

What is claimed is:

1. A portable vanity mirror for use on vanity cabinets and table tops comprising;

a. an elongated arcuately curved stanchion rod which has a lower vertical support leg, a lower section which curves rearwardly and upwardly from said support leg, and an upper section which curves forwardly and upwardly from said lower section, said upper section terminating in a generally horizontally disposed upper arm, b. a support base removably attachable to said support leg, c. a mirror frame holding concentrically therewithin at least a first mirror plate, and a second mirror plate back-to-back with said first mirror plate, and d. a coupling mechanism which joins said mirror frame to said arm, said coupling mechanism including a first rotatable joint disposed between said mirror frame and said stanchion which enables said frame to be rotated about a first axis relative to said stanchion.

2. The mirror of claim 1 wherein at least a portion of said mirror frame is located within a concave space formed between said lower and upper sections of said stanchion, when said mirror frame is oriented parallel to said stanchion.

3. The mirror of claim 1 wherein said coupling mechanism is further defined as enabling motion of said mirror frame to an adjustable height relative to said support base.

4. The mirror of claim 1 wherein said first rotation axis is further defined as being transverse to said arm.

5. The mirror of claim 1 wherein said coupling mechanism is further defined as including a second rotatable joint attached to said arm having a second rotation axis.

6. The mirror of claim 5 wherein said second rotatable joint is further defined as being rotatably adjustable about a central longitudinal axis of said arm.

7. The mirror of claim 6 wherein said first rotatable joint is further defined as being a ball-and-socket type joint.

8. The mirror of claim 7 wherein said ball-and-socket type joint is further defined as including a ball located at the end of a shank fixed to one of said second rotatable joint and said mirror frame, said ball being rotatably and swivelably held within a socket attached to the other of said second rotatable joint and said mirror frame.

9. The mirror of claim 8 wherein said shank of said ball-and-socket joint is disposed transversely to said arm.

10. The mirror frame of claim 9 wherein said second rotatable joint is further defined as being a bushing rotatable about a longitudinal axis of said arm, said bushing including a locking mechanism for locking said bushing at an adjustable orbital angle relative to said arm.

11. The mirror of claim 10 wherein said shank of said ball protrudes radially from said bushing.

12. The mirror of claim 5 wherein said second rotation axis is further defined as being parallel to said arm.

13. The mirror of claim 12 wherein said second joint is further defined as being a bushing orbitatally rotatably mounted to said arm.

14. The mirror of claim 12 further including a locking mechanism for securing said bushing at adjustable orbital angles relative to said arm.

15. The mirror of claim 14 wherein said locking mechanism is further defined as being a screw tightenable in a bore disposed radially through said bushing onto said arm.

16. The mirror of claim 14 wherein said second joint is further defined as including a first joint member which protrudes radially outwards from said bushing.

17. The mirror of claim 16 wherein said first joint member is further defined as being one of a ball and socket of a ball-and-socket type joint.

18. The mirror of claim 17 wherein said second joint is further defined as including another of said ball and socket attached to said mirror frame.

19. The mirror of claim 18 wherein said second joint includes a member disposed radially outwardly from said frame.

* * * * *